US009756432B2

(12) United States Patent
Huit

(10) Patent No.: US 9,756,432 B2
(45) Date of Patent: Sep. 5, 2017

(54) HEARING AID CONTAINER

(71) Applicant: Calvin Huit, Meridian, ID (US)

(72) Inventor: Calvin Huit, Meridian, ID (US)

( * ) Notice: Subject to any disclaimer, the term of this patent is extended or adjusted under 35 U.S.C. 154(b) by 333 days.

(21) Appl. No.: 14/607,925

(22) Filed: Jan. 28, 2015

(65) Prior Publication Data

US 2015/0264490 A1 Sep. 17, 2015

Related U.S. Application Data

(60) Provisional application No. 61/952,691, filed on Mar. 13, 2014.

(51) Int. Cl.
*H04R 25/00* (2006.01)

(52) U.S. Cl.
CPC ..... *H04R 25/00* (2013.01); *H04R 25/60* (2013.01); *H04R 25/602* (2013.01); *H04R 25/658* (2013.01); *H04R 25/552* (2013.01); *H04R 2460/17* (2013.01)

(58) Field of Classification Search
CPC ..... H04R 25/00; H04R 25/602; H04R 25/65; H04R 25/658; H04R 2225/021; H04R 2225/31; H04R 2460/03; H04R 2460/17; H04R 25/60; H02J 7/0045; H02J 7/0054
USPC ..... 381/322, 323, 324, 330, 381, 189; 320/107, 108
See application file for complete search history.

(56) References Cited

U.S. PATENT DOCUMENTS 2,636,598 A 4/1953 Hopgood
3,485,416 A 12/1969 Fohrman
4,418,819 A 12/1983 Shapiro
4,444,324 A 4/1984 Grenell
5,803,259 A 9/1998 Riedel
5,871,116 A 2/1999 Picchietti
6,092,717 A 7/2000 Lowry
D491,811 S 6/2004 Kostow
D491,819 S 6/2004 Kostow
D517,243 S 3/2006 Martinez
8,180,083 B2 * 5/2012 Campbell ..... H04R 25/65 381/189
8,548,182 B2 * 10/2013 Yasui ..... H01M 2/1044 381/322
2005/0041827 A1 * 2/2005 Wu ..... H02J 7/0045 381/323

OTHER PUBLICATIONS

Coghlan's 8236 Backbacker's Salt and Pepper Shaker, http://www.sportco.com/store/pc/Coghlan-s-Backpacker-s-Salt-Pepper-Shaker-8236-910p74135.htm.
MSR Alpine Salt and Pepper Shaker, http://www.cascadedesigns.com/msr/cookware/cookware-accessories/alpine-salt-and-pepper-shaker/product.
GSI Outdoor Salt & Pepper Shaker, www.gsioutdoors.com/salt-pepper-shaker.html.
Coleman Salt & Pepper Shaker, www.coleman.com/product/salt-and-pepper-shaker/20000016388?contextCategory=5150#.VbjRy9K6eUk.
GSI Spice Missile, www.gsioutdoors.com/spice/missile.html.

* cited by examiner

*Primary Examiner* — Huyen D Le
(74) *Attorney, Agent, or Firm* — Robert L. Shaver; Shaver & Swanson, LLP

(57) ABSTRACT

A container for storage of hearing aids. The container has storage tubes, one for each hearing aid of a pair of hearing aids, and a center piece to which the storage tube attach. Attachment of the storage tubes can be by threaded engagement. The container has a desiccant pack for drying the hear aids, an o-ring closure for waterproofness, and a padded inner wall for protection of hearings aids.

22 Claims, 5 Drawing Sheets

HEARING AID CONTAINER

PRIORITY/CROSS-REFERENCE TO RELATED APPLICATIONS

This application claims the benefit of U.S. Provisional Application No. 61/952,691, filed Mar. 13, 2014, the disclosure of which is incorporated by reference.

TECHNICAL FIELD

The disclosed technology generally relates to device for storing hearing aids, and more particularly to hearing aid containers for storage of two hearing aids.

BACKGROUND

Hearing aids are expensive devices, costing as much as $5,000 each. Unfortunately they are also easy to lose or destroy. Once a person loses a pair of $10,000 hearing aids, they are always on the lookout for better ways to store them and keep them secure from the environment and from being destroyed. They are small devices which fit in peoples' ears but they are not worn all day. To wear them all day would become irritating and tiresome, and typically a person takes them in and out of their ears several times a day as needed. If they are placed in a shirt pocket, they can easily be lost when the shirt goes through the laundry, or they can easily fall out of the shirt pocket. Hearing aids can also be readily sucked up by vacuum cleaners in an automobile setting or at home. They are typically not waterproof and they are easy to get wet and therefore ruined, they are not crush proof, they are so small that they are easy to lose. Another thing that is useful for users of hearing aids is to have a container which includes a replaceable desiccant pack, which keeps the humidity inside the container low, so that when hearing aids are placed in the container they tend to dry out. Storage space for batteries is also helpful, and small tools may be useful for keeping the hearing aid clean and workable. This can include a small brush or a cloth with which to wipe the hearing aid.

Containers which hold hearing aids are presently available but do not solve all of the problems which are faced by hearing aid users, and do not adequately protect the expensive hearing aids, and are not compact enough to be easily carried. Some other issues users have with hearing aids are these:

The hearing aid batteries may go dead and the use doesn't have any extra with him/her.

The user is getting a haircut, shampoo, or hairdo, and the hearing aids are at risk of being lost in the process.

The user needs to remove the hearing due to being in a noisy place, like restaurants, graduations, church, sports, or other public events make it hard to hear and the noise is irritating, so hearing aids are removed from the ears.

The user's dog (or cat) has a habit of playing with the user's hearings aids, so they can't be left lying around.

If the user places his/her hearing aids in a shirt pocket, they can fall out when The user bend over and land in the sink, tub, or toilet, or simply be stepped on, ran over, or lost.

If a user puts his/her hearing aids in his/her pocket, they could end up in the washing machine.

If a user puts her hearing aids in a purse, they can get damaged by being thrashed around loose in a purse.

The hearing aids can fall or get bumped off the end table or night stand and be stepped on, or if someone is using an adjacent rocking chair or recliner, crushed.

The hearing aids are small, and get lost easily.

The user may be out a walk, hike, or bicycle ride and get caught in the rain, the hearing aids may be damaged by water.

The user is out on a windy day, and the wind hitting against the hearing aid's microphone sounds like a jet engine in your ear, and after just a few minutes your nerves are rattled beyond description, at which time the user removes the hearing aids and runs the risk of losing them.

The user finds himself around a work environment where loud tools are in use, or where noisy work is being done, like out on the farm operating a tractor—maybe the user is around other loud equipment, The user removes the hearing aids and risks losing them.

The user may find herself in a dusty environment like driving down a dirt road or trail with friends, maybe in the desert geo-caching, or maybe the construction site next door is creating a lot of dust. The user removes the aids, and risks losing them.

The user plans to be around water boating, skiing, swimming, river rafting, or fishing on a float tube and the risk of taking a plunge and ruining her hearing aid is too great. The user may want to walk the beach along the ocean and feel the breeze as the fog rolls in, remove the hearing aids, and risk losing them.

The user may like to drive down the road with the window down. The hearing aids have to be removed due to the wind noise, and then the user would be at risk of losing them.

The user may be away from home for a while visiting friends or family, on a backpacking trip, vacation, or cruise, and will need a safe dry place to put your hearing aids while traveling, particularly during adverse weather.

The user may perspire a lot at the gym, on the job, or just being out in the heat, and don't welcome the risk of damaging the hearing aid—or listening to the raspy sound they emit having been exposed to the excessive body moisture. To take the hearings aids out exposes them to greater risk of being lost or damaged.

The user wants the inside of his ears to dry after taking a shower before inserting the hearing aid in his ears. Not having a secure storage device puts the user's hearing aids at risk.

As a hearing impaired person, the user cannot relax and have noise. When trying to relax the user not only wants his/her hearing aid out of the ears, but a set of plugs to replace them, as total silence is the relaxed environment of choice for the hearing impaired, because a hearing impaired person expends much effort trying to hear and interpret what is being said, sung, or done. But to take out the hearing aids, is to expose them to greater risk.

Five years ago the average age of first time hearing aid purchaser was 75; today it's closer to 65. In part, with the use of smart phone integrated music and mp3 players, there are an increased number of younger people in need of hearing aids. It is projected that this, along with the baby-boom generation, will continue to redefine the age of the first time hearing aid purchaser, continuing the current trend.

As the age of the hearing aid wearer changes, so do the needs and expectations. The existing clam-shell case solution for hearing aid management, mostly intended to sit on the nightstand, no longer meets the expectations of the hearing aid dependent consumer. A more robust, compact, take-on-the-go, feature rich solution is needed.

SUMMARY OF THE DISCLOSURE

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept(s) in any way.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

Disclosed is a protective container for storing hearing aids, and for storage of hearing aid tools and batteries. One version of the container can include two storage tubes which attach to each other end to end, such as by threads, or by a twist connection. In this configuration, one of the storage tubes would have a female thread, and the other could have a male thread. Each storage tube has a first end and a second end, with the second end being closed off by a bottom which is typically flat but could be curved. The first end of each of the storage tubes is threaded for joining the two storage tubes to each other end to end. The container includes a replaceable desiccant pack positioned inside at least one of the storage tubes for absorbing moisture and drying the hearing aids. At least one of the storage tubes has an o-ring groove adjacent to the threads, with an o-ring in the groove, to provide a waterproof seal when the tubes are joined to each other. A recess may be present for storage of tools for hearings aids, such as brushes or picks. A recess may be present for storage of spare batteries. An insert with holes may be present which provides a storage place for spare batteries.

Another version of the disclosed container utilizes three separate sections, a first storage tube, a second storage tube, and a connector piece. The first and second storage tubes each have a first and second end as well as a hollow interior. The first ends of the first and second storage tubes each have a set of threads, for threaded attachment to the connector piece, which also is threaded at each of its sides. On one version, the connector piece has male threads, and each of the storage tubes has female threads, but obviously any combination of compatible threads can be utilized. Other closures than threads also fall within the disclosed technology, such as a bayonet fitting, a twist fitting, a friction fit, or a magnetic closure to join the two storage tubes to the connector piece. The connector piece has a first side and a second side.

In order to prevent water from entering the interior of the first and second storage tubes, o-rings are positioned in o-ring grooves to form seals between the first and second storage tubes and the connector piece. The o-rings can be positioned around the male threads of the connector piece or placed within the female threads of the first of second storage tubes. In either of these configurations when the first or second storage tube is rotated onto the connector piece, the rotating force causes the o-ring to become compressed and form a seal. In order to provide a drying environment for the hearing aids, a removable desiccant pack can be placed within the container. One configuration includes a desiccant pack located in the connector piece, with the desiccant pack exposed to air inside the first and second container, and thus helping to dry hearings aids in both of the storage tubes.

Additionally a tool holder can be built into the container. In one embodiment the tool holder is a hollow space extending into the first side of one or both of the storage tubes. The tool holder is configured to hold a tool, such as a vent cleaning tool, a brush, or wax filter. One type of tool is called a wax basket tool, and has a replacement basket on one end, and a barbed hook on the other end to engage and remove the old wax basket. The vent cleaning tool is used to clear the hearing aid venting. The cleaning brush is used to clear debris from the exterior of the hearing aid, and the wax filters are stored for availability when the end of the aid becomes clogged and the wax filter needs to be replaced.

Additionally the container can house a battery storage recess or a battery dispenser. The battery storage recess may be a disk shaped resilient piece with battery positions defined in the resilient piece. The battery dispenser can also be mounted in any of the sections. Preferably the battery dispenser also has an elastically compressible member located within, such as a spring, in order to ease the loading and unloading of the batteries. In this configuration it is also possible for the tool to incorporate a magnet. This magnet would be capable of manipulation of a battery into the battery dispenser, out of the battery dispenser or into the hearing aid. One configuration of battery storage is a foam insert on one of both sides of the connector piece. The foam insert has holes for a frictional engagement with batteries.

Also located in the container can be a wireless tracking device. This device can be located in any of the sections and it can be capable of wireless communication with a personal electronic device, such as a cell phone, tablet, pad, or laptop. This communication can be done through many types of systems such as Bluetooth Communication, Wi-Fi, cell phone technology, or Near Field Communication.

The disclosed container allows for convenient, crushproof and waterproof storage of hearing aids. The storage container fits in a man's shirt pocket or in a woman's purse. If made of sturdy material such as aluminum, metal or durable plastic, the container can be resistant to crushing by a vehicle, as well as waterproof, and can be configured to float in water. One or more of the storage tubes may also contain a cushioning liner for softening impacts with the hearing aids and the storage tube walls. The cushioning liner may be a tubular piece of material placed adjacent to the inside wall of the storage tubes.

Also, the device may be a single tube, with a dividing wall and removable end caps, thus forming a first storage which is joined to a second storage tube. If made as a single tube with end to end compartments, each compartment for a single hearing aid would have removable caps on each end, for closing the ends. The removable caps could be snap on, threaded, or use other end closures such as magnetic, twist lock, or friction closures.

A version is possible for over the ear hearing aids in which the hearing aid cavity is larger in diameter, and could have a single compartment for one aid, or two back-to-back compartments for two aids. The compartments for tool and battery storage could be present in all embodiments.

The disclosed technology can be sized for different kinds of hearing aids, such as In-The-Ear (ITE) hearing aids, and Behind-The-Ear (BTE) hearing aids. The disclosed technology storage device is light weight, crush resistant, compact, and water protected. It also has a lanyard attachment, providing the ability to hang the device from the wrist, neck, or a backpack. It is lined with FDA approved padding material and includes a battery management compartment for each hearing aid that holds up to 3 batteries. It can be color anodized keeping with the industry standard for right and left hearing aids: deep red and rich blue, respectively. The storage device is sealed with an FDA approved rubber o-ring to keep moisture out and hearing aids dry.

An embodiment with a tracking unit is an option, with a GPS or phone triangulation tracker inserted inside the hearing aid container. A unit in the connector piece is one embodiment.

DETAILED DESCRIPTION OF THE EXEMPLARY EMBODIMENTS

Figure 1:
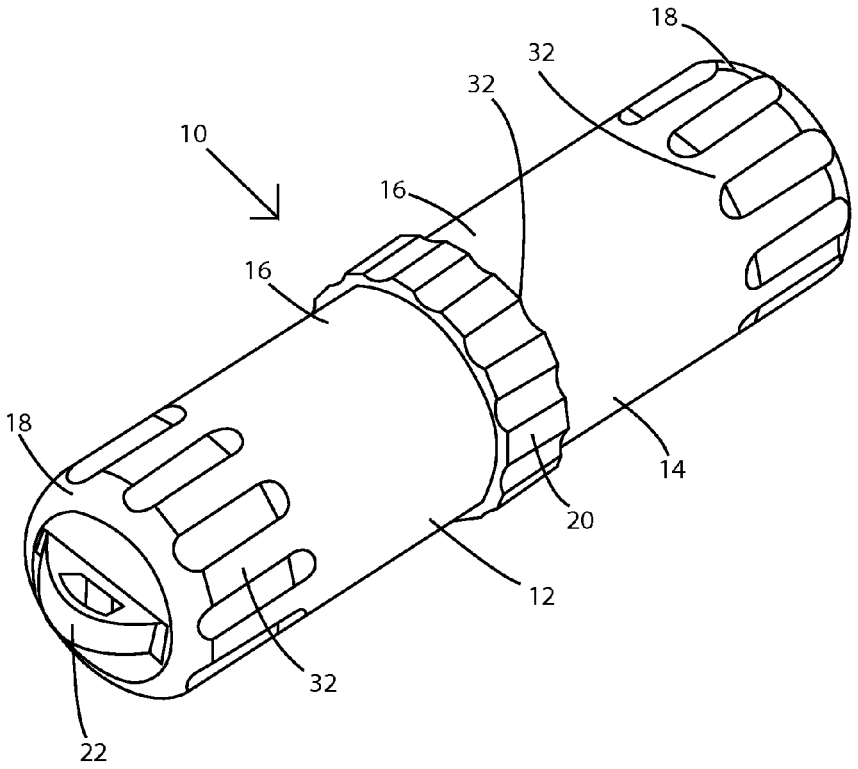
FIG. 1 is a perspective view of a three piece embodiment of the container.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Shown in FIGS. 1-9 are certain preferred embodiments of the invention. FIG. 1 shows a container 10 of the disclosed technology, for storing hearing aids. It is made up of a first storage tube 12 and a second storage tube 14. Both storage tubes have a first end 16 and a second end 18. The first ends 16 are attached to a connector piece 20. In the version shown in FIG. 1, the overall size of the storage container is approximately 4¼ inches, with a diameter of approximately 1 inch. These dimensions are not critical, and could be slightly larger or slightly smaller and still function well for the purpose. The storage container 10 can be made of metal or plastic, or other materials as long as the materials are sturdy enough to resist crushing, including crushing by a tire of a vehicle. The storage tubes 12 and 14 can be lined with a storage tube liner 46 which can include a liner end piece 48. These can be of a cushioning material such as rubber and provide some cushioning if the hearing aids are bounced around inside the container. The liner can be of different thicknesses, for sizing the interior of the tubes for different sized hearing aids. The storage tube liner 46 is preferably about 1 inch wide by 2 and ⅝ inches long and is rolled into a tube to form a tube 1 inch long. The end liner piece is preferably ⅞ inches in diameter, but these sizes would obviously change with different sizes of storage tubes. The storage tubes would typically follow the conventions of the industry, with one tube being red in color to indicate use with the right hearing aid, and the other would be blue, to indicate use with the left hearing aid.

Figure 2:
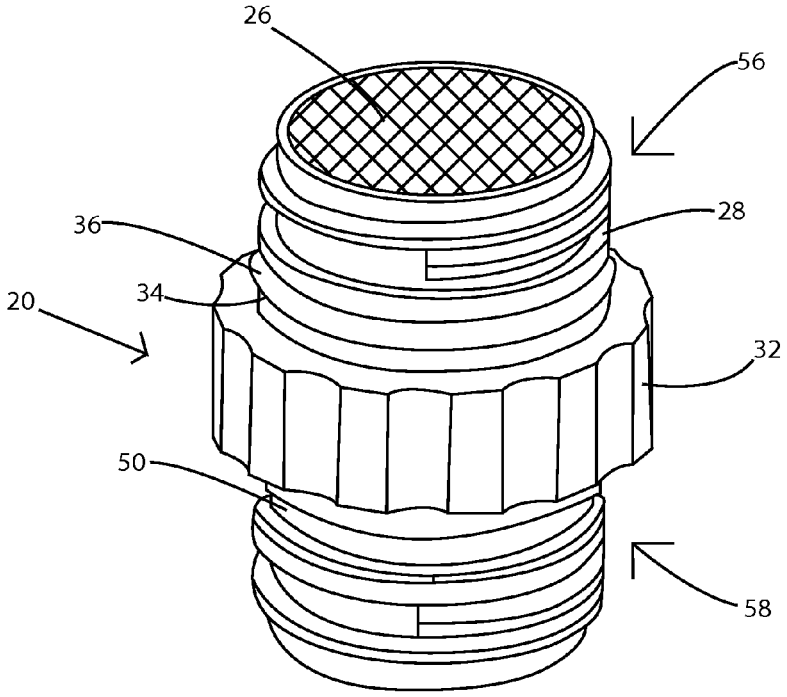
FIG. 2 is a perspective view of a connecting piece of the container.
Figure 3:
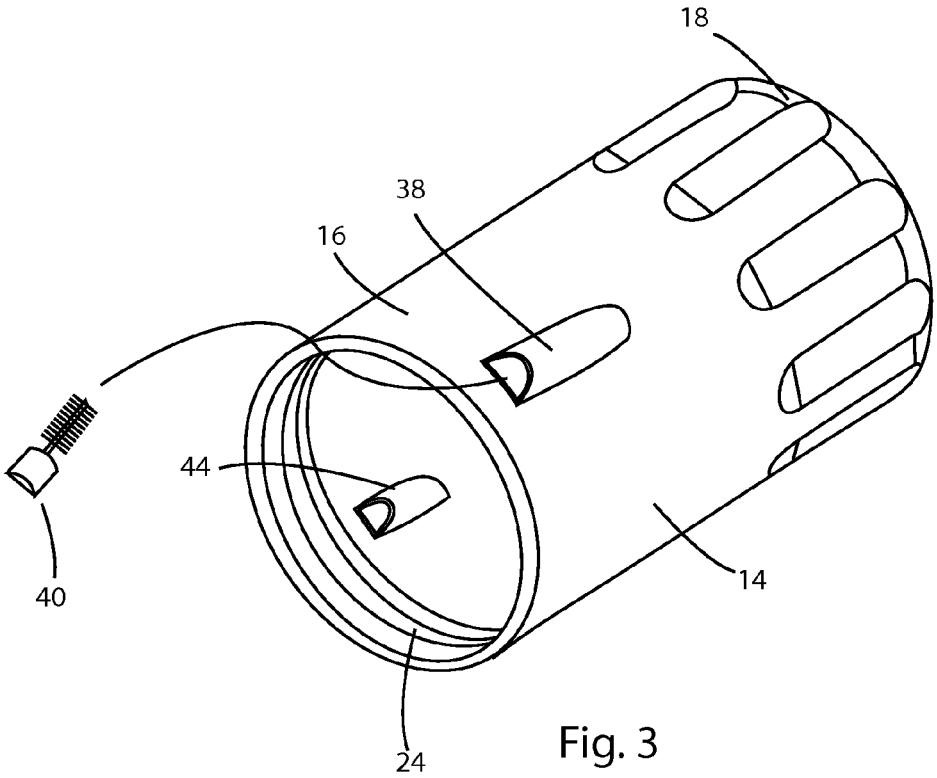
FIG. 3 is a perspective view of a storage tube of the container.

The storage tubes and the connector piece 20 can include gripping ridges 32 which provide for more secure access to turning and opening the storage tubes 12 and 14. Shown in FIG. 2 is an o-ring 36 and an o-ring groove 34. Other means of closure and making waterproof can also be used, such as use of a gasket. A second o-ring groove is shown as 50. FIG. 2 shows threads 28, which in this embodiment are male threads which interact with female threads 24, shown in FIG. 3. FIG. 2 also shows the desiccant pack 26, which is removable and replaceable. Shown in FIG. 3 is a tool holding recess 38, which can take a number of forms and can be inside or outside the container. Shown in FIG. 3 is a tool 40 which in this case is a brush with a handle which fits by friction into the tool holding recess 38. Shown in FIG. 3 is a battery holder 44 which in this case is a tube formed in the inside of one of the storage tubes, which defines a generally cylindrical region in which batteries may be placed. The batteries can be removed by the use of a tool which includes a magnet, such as a tool shown in 40 in which the handled part of the bush is a magnet.

Figure 4:
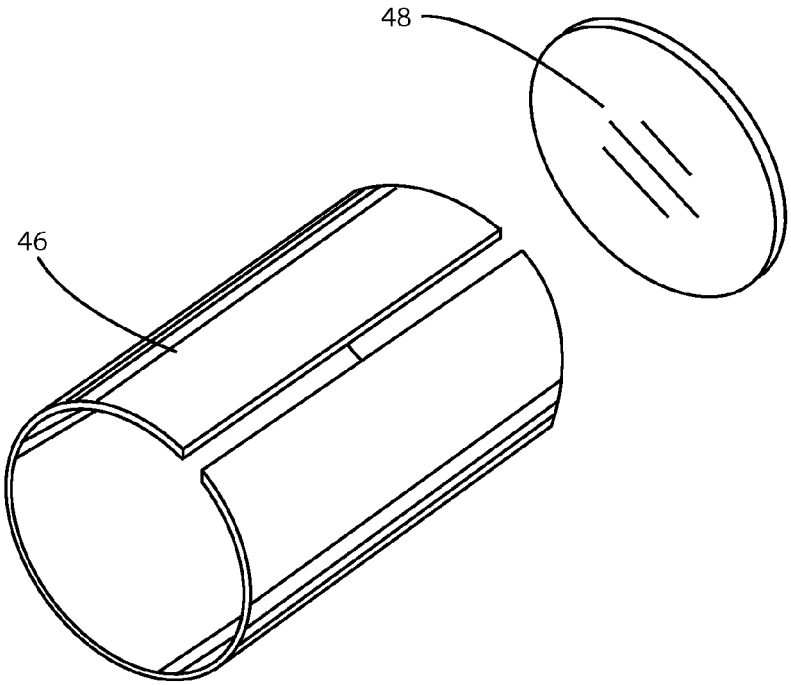
FIG. 4 is a perspective view of a resilient liner for a storage tube.

FIG. 4 shows a storage tube liner 46, and an end liner piece 48. These can be of different thicknesses to limit the bouncing of the hearings aids, as well as to cushion any movement of the hearing aid.

Figure 5:
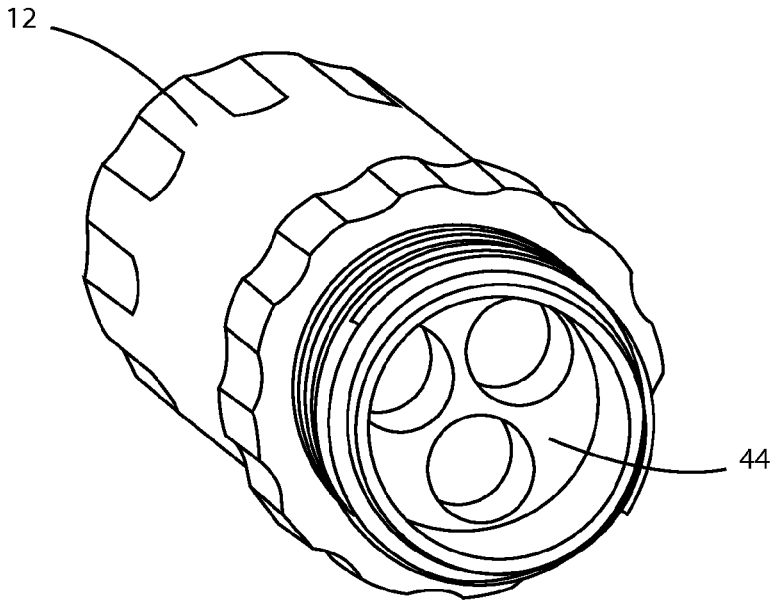
FIG. 5 is a perspective view showing the battery storage.

FIG. 5 is a first storage tube showing the end view, with a battery holder 44 shown inside. This type of battery storage would preferably be of a foam material, with holes in which the batteries are placed, and held until they are ready for use. The holes for the batteries can be circular, pie piece shaped, wedge shaped, or generally rectangular with curved sides. The battery storage disc would typically be foam, which fits in the connector piece by friction, and which holds the batteries in place by friction.

Figure 6:
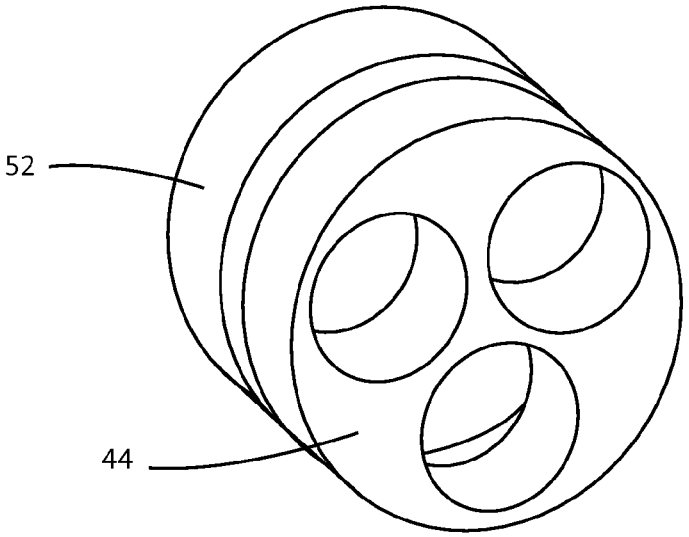
FIG. 6 is a perspective view of the foam block battery storage.

FIG. 6 shows the battery holder 44 which could be placed in each of the storage tubes. This version could be made of foam, and this version is designed to hold 3 batteries each. Also shown in FIG. 6 is an electronic tracker 52, which could be a GPS based, Bluetooth based, cell phone based, or other electronic tracking technologies, for finding lost or misplaced containers. The electronic tracker 52 can be located in the connecting piece as shown, or could be in other locations inside the container 10, or could be attached as an add on to the outside of the container, such as attached to the carrying loop or lanyard hole 22, located on one end of a storage tube.

Figure 7:
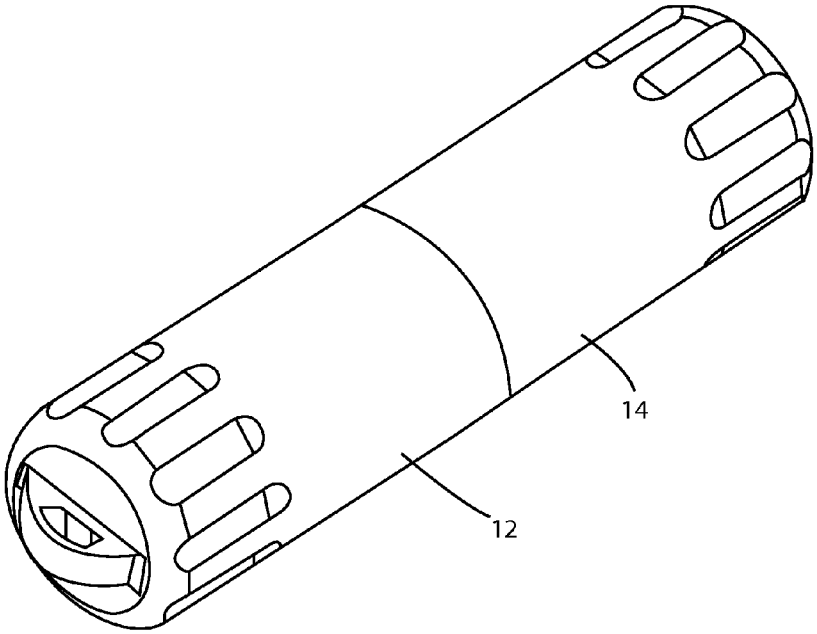
FIG. 7 is a perspective view of one embodiment of the disclosed hearing aid container.

FIG. 7 shows a hearing aid container made up of two storage tubes, with no connector piece.

Figure 8:
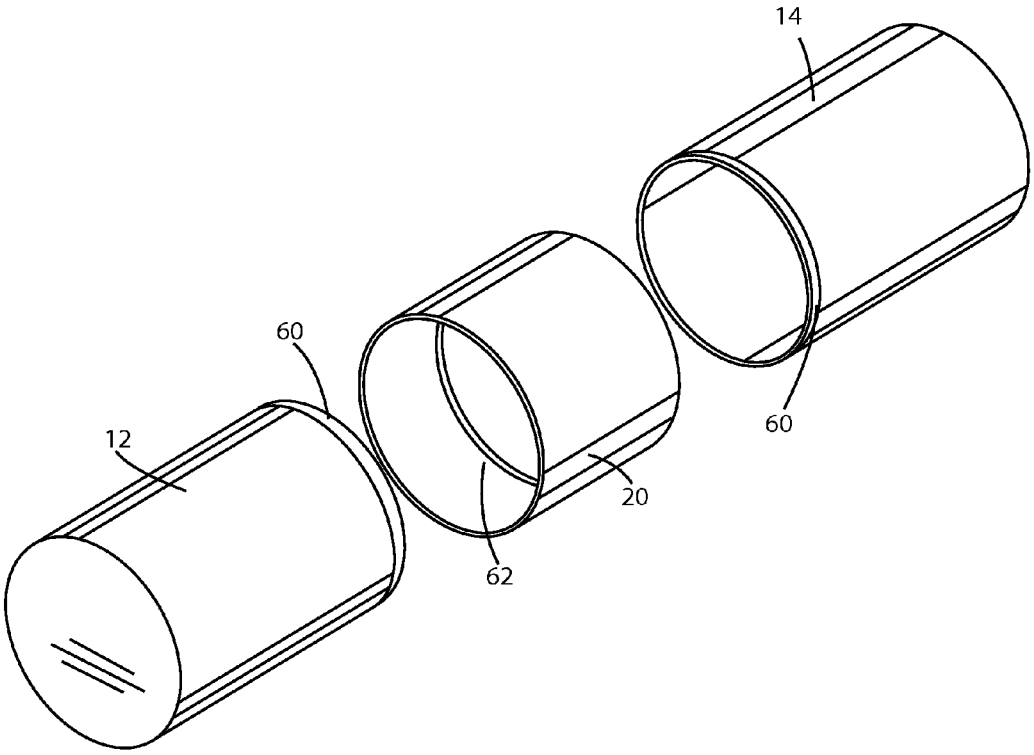
FIG. 8 is a perspective view of an alternate embodiment of the disclosed hearing aid container.

FIG. 8 shows an alternative embodiment of the device, in which the first storage tube 12 and the second storage tube 14 engage the connector piece 20 in a frictional fit. Shown is a ridge 60 on the rim of the storage tubes 12 and 14, which engages one or more grooves 62 on the inside wall of the connector piece 20. Alternatively, the connector piece 20 could be smaller in diameter than the storage tubes, and fit inside the storage tubes, with the rims on either end of the connector piece having ridges, and the inside wall of the storage tubes having a groove for engagement of the ridge. In either embodiment, the connector piece would have a battery storage piece and optionally could have desiccant packs and an electronic locating beacon.

Figure 9:
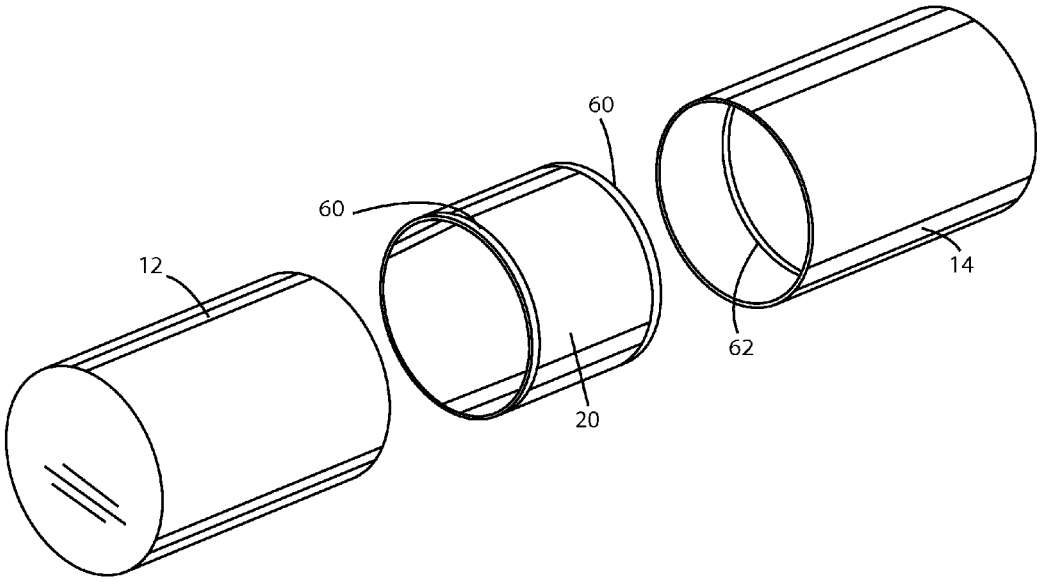
FIG. 9 is a perspective view of an alternate embodiment of the disclosed hearing aid container.

FIG. 9 shows an embodiment in which the connector piece 20 is smaller in diameter than the storage tubes 12 and 14, and the connector piece 20 has ridges 60 on each end, and the storage tubes 12 and 14 have grooves 62 on the interior wall of the storage tubes, with the ridges engaging the grooves to form a seal. In either the version shown in FIG. 8 or FIG. 9, an interior annular wall next to the groove 62 can define an o-ring position between the ridge and the annular wall, to form a more water tight seal.

While certain exemplary embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

I claim:

1. A container for storing hearing aids comprising:

a first storage tube and a second storage tube, each storage tube having an open and threaded first and a closed off second end, and a hollow interior configured for holding a hearing aid, said first end of each of said first and second storage tubes having a threaded portion for threaded connection to each other at said first ends;

at least a first o-ring positioned adjacent to said threaded portion in an o-ring groove in one of said storage tubes, for engaging a connected storage tube and sealing the hollow interior of said tubes from outside contamination; and a battery holder, for storing hearing aid batteries.

2. The container for storing hearings aids of claim 1, which further comprises a desiccant pack positioned in at least one of said storage tubes, for absorbing moisture from inside at least one of said storage tubes.

3. The container for storing hearing aids of claim 1, which further defines at least one tool holding recess in at least one of said storage tubes; and at least one tool for removable placement within said tool holding recess.

4. The container for storing hearing aids of claim 1 which further comprises a connector piece having a threaded first end and a threaded second end, with said threaded first end and said threaded second end of said connector piece threaded for engagement with said first and second storage tubes.

5. A container for storing hearing aids comprising:

a first storage tube and a second storage tube, each storage tube having a first and second end, and an interior configured for holding a hearing aid, said first end of said first tube having a threaded portion for threaded connection to a connector piece, and with said first end of said second storage tube having a threaded portion for threaded connection to said connector piece;

a connector piece third section having a threaded first end and a threaded second end, each end of said connector piece configured for threaded engagement with said first end of said first storage tube and said first end of said second storage tube;

a first o-ring positioned to form a seal between said threaded portion of said first storage tube and said threaded first end of said connector piece third section;

a second o-ring positioned to form a seal between said threaded portion of said second storage tube and said threaded second end of said connector piece third section; and a battery holder mounted in said connector piece, for storing batteries for said hearings aids.

6. The container for storing hearings aids of claim 5 which further comprises a desiccant pack wherein said desiccant pack is exposed to said interior of said first and second storage tubes when said threaded portions of said first and second storage tubes and said threaded first and second ends of said third section are engaged.

7. The container for storing hearing aids of claim 5 in which desiccant pack is mounted in said connector piece.

8. The container for storing hearing aids of claim 5 which further comprises a cushioning liner in said storage tubes, for restricting the movement of hearings aids enclosed in said storage tubes, and for softening impacts with said hearing aids and the storage tube walls.

9. The container for storing hearing aids of claim 8 in which said cushioning liner is comprised of a flat circular piece against the bottom of the storage tubes, and a tubular piece adjacent to the inside wall of said storage tubes.

10. The container for storing hearing aids of claim 5 in which said connector piece has male threads on each end of said connector piece, and in which said storage tubes each have female threads in said first ends, for engagement with said connector piece threads.

11. The container for storing hearing aids of claim 5 in which said battery holder is a disk shaped resilient piece attached to said connector piece, with battery positions defined in said resilient piece.

12. The container for storing hearings aids of claim 5 which further comprises an electronic locating beacon.

13. A container for storing hearing aids comprising:

a first storage tube and a second storage tube, each storage tube having a first and second end, and an interior configured for holding a hearing aid, said first end of said first tube having a threaded portion for threaded connection to a connector piece, and with said first end of said second storage tube having a threaded portion for threaded connection to said connector piece;

a connector piece third section having a threaded first end and a threaded second end, each end of said connector piece configured for threaded engagement with said first end of said first storage tube and said first end of said second storage tube;

a first o-ring positioned to form a seal between said threaded portions of said first storage tube and of said connector piece;

a second o-ring positioned to form a seal between said threaded portions of said second storage tube and said connector piece;

a disk shaped battery storage unit attached to said connector piece, with battery positions defined in said storage unit; and a desiccant pack wherein said desiccant pack is exposed to said interior of said first and second storage tubes when said threaded portions of said first and second storage tubes and said threaded first and second ends of said third section are engaged.

14. The container for storing hearing aids of claim 13 in which desiccant pack is mounted in said connector piece.

15. The container for storing hearing aids of claim 13 which further comprises a cushioning liner in said storage tubes, for restricting the movement of hearings aids enclosed in said storage tubes, and for softening impacts with said hearing aids and the storage tube walls.

16. The container for storing hearing aids of claim 15 in which said cushioning liner is comprised of a flat circular piece against the bottom of the storage tubes, and a tubular piece adjacent to the inside wall of said storage tubes.

17. The container for storing hearing aids of claim 13 in which said connector piece has male threads on each end of said connector piece, and in which said storage tubes each have female threads in said open first ends, for engagement with said connector piece threads.

18. The container for storing hearing aids of claim 13 which further comprises said battery storage unit, for storage of batteries for said hearings aids.

19. The container for storing hearings aids of claim 13 which further comprises an electronic locating beacon.

20. A container for storing hearing aids comprising:

a first storage tube and a second storage tube, each storage tube having an open first end and a closed second end, and an interior space configured for holding a hearing aid;

a connector piece having a first end and a second end, each end of said connector piece configured for frictional engagement with said first end of said first storage tube and said first end of said second storage tube by a ridge and groove connection between said connector piece and said storage tubes; and a disk shaped battery storage unit attached to said connector piece, with battery positions defined in said storage unit.

21. The container for storing hearings aids of claim 20 in which said first ends of said storage tubes further comprise a ridge, and said connector piece has an interior wall, said interior wall comprising a groove configured for interfitting frictional engagement with said ridge on said storage tubes.

22. The container for storing hearings aids of claim 20 in which said ends of said connector piece further comprise ridges, and each of said storage tube has an interior wall, said interior walls comprising a groove configured for interfitting frictional engagement with said ridge on said connector piece.

* * * * *